US006942214B2

(12) United States Patent
Riccardi

(10) Patent No.: US 6,942,214 B2
(45) Date of Patent: Sep. 13, 2005

(54) MAIL REGISTRATION AND FEEDING APPARATUS

(75) Inventor: Victor Riccardi, Stamford, CT (US)

(73) Assignee: Pitney Bowes Inc., Stamford, CT (US)

( * ) Notice: Subject to any disclaimer, the term of this patent is extended or adjusted under 35 U.S.C. 154(b) by 370 days.

(21) Appl. No.: 09/749,361

(22) Filed: Dec. 27, 2000

(65) Prior Publication Data

US 2002/0079636 A1 Jun. 27, 2002

(51) Int. Cl.[7] ..... B65H 9/00
(52) U.S. Cl. ..... 271/227; 271/251
(58) Field of Search ..... 271/227, 228, 271/250, 251, 252

(56) References Cited

U.S. PATENT DOCUMENTS 4,669,718 A * 6/1987 Rovin ..... 271/227
4,693,460 A * 9/1987 Adamson et al. ..... 271/10.05
4,753,432 A 6/1988 Freeman ..... 271/35
4,973,037 A 11/1990 Holbrook ..... 271/2
5,050,857 A * 9/1991 Aoto ..... 271/227
5,112,037 A 5/1992 Holbrook ..... 271/2
5,219,159 A * 6/1993 Malachowski et al. ..... 271/228
5,485,989 A 1/1996 McCay et al. ..... 271/2
5,697,608 A * 12/1997 Castelli et al. ..... 271/228
6,267,372 B1 * 7/2001 Mylaeus et al. ..... 271/250
6,356,735 B1 * 3/2002 Hozumi ..... 399/395

FOREIGN PATENT DOCUMENTS

WO WO 98/28212 * 7/1998 ..... B65H/9/16

* cited by examiner

*Primary Examiner*—Kathy Matecki
*Assistant Examiner*—Mark A. Deuble
(74) *Attorney, Agent, or Firm*—Brian A. Lemm; Angelo N. Chaclas

(57) ABSTRACT

This invention concerns a feeding and advancing apparatus in a document processing machine for aligning and registering flat articles against a registration wall. The articles are advanced through a first feeding apparatus that pushes them towards a registration wall, and a second feeding apparatus advances them along a second direction substantially orthogonal in relationship to the first feeding apparatus when a registration sensing system causes the second drive system to engage the articles. If there is not registration of the articles at the registration wall, the first feeding apparatus will re-establish the prior registration condition when the second feeding apparatus is disengaged. Then, the first feeding apparatus will re-establish registration. Once the articles are re-registered, the second feeding apparatus will be engaged to continue advancing the articles along the second direction to the desired downstream location.

1 Claim, 21 Drawing Sheets

MAIL REGISTRATION AND FEEDING APPARATUS

FIELD OF THE INVENTION

The present invention is directed to sheet, envelope, mail and general flat article or media processing equipment. The invention may be applied to a sheet, letter or mail-processing machine, all of which are paper and envelope equipment that the present invention may be utilized in. The present invention provides a way to receive, advance and register sheets, letters, mail or envelopes of all sizes that are deposited on the input feed deck individually, or in a stack. The media is automatically advanced along a feed path while being registered along one edge for processing such as printing in a down-stream location. The present invention provides a media feeding and registration apparatus that eliminates the need for structural appendages such as a sheet, letter or envelope guide to help achieve the desired registration of the media in all systems that process sheets, flat mail, postcards, sheet, or envelopes of different sizes. Background of the Invention.

BACKGROUND OF THE INVENTION

There are presently many variations of sheet handling, envelope feeders and mail handling equipment that will feed one or more envelopes or mail from an input hopper. The feeding and advancing mechanisms in such equipment will push or convey such material, or flat media along an input feed path to a separating station. Depending on if there is a stack of material, the separating station will ultimately feed one piece forward as intended. The separating station will restrict the amount of material, or media that will be fed forward. An example of this arrangement may be seen in U.S. Pat. No. 5,112,037 to Holbrook for FRONT FEEDER FOR LARGE SIZE MAIL HANDLING MACHINE, U.S. Pat. No. 4,973,037 to Holbrook for FRONT END FEEDER FOR MAIL HANDLING MACHINE and U.S. Pat. No. 4,753,432 to Freeman for FEEDER MODULE. This type of feeding device typically has a structural mechanism located to engage the near lateral edge portions of the sheets, envelopes and mail that may be placed on the feed deck, the structure intended to help guide each piece. In such prior art, the side guiding structure is necessary to insure that each mail-piece; envelope or other flat media article is properly registered at the upper side. In addition, there is a need to alleviate some of the concern on the part of the machine operator in regards to placement of the material in a feed hopper or feeding plate. The present invention permits the machine operator to place the material on the feeding plate or feeding deck, knowing that it will be registered, guided and transported automatically to it's downstream location or function.

The prior art moves the media downstream, but only when the individual article or stack of articles to be fed is nearly aligned with the intended path of travel. If there is a significant angular difference (less than 90 degrees), the article may not properly register against a registration wall or surface as desired because of the tendency of the material to rotate at the leading or trailing ends of the article. This is why the structural guides placed at the front operator side of the equipment are necessary. These structures are designed to be a second guiding arrangement; more or less insuring the media will be placed on the feed deck at a substantially parallel relationship with the registration wall to begin with. The present invention eliminates such side guiding structure, and utilizes a feeding system that eliminates skewing of the material in advance of the next downstream function.

Registration at the upper end of all media being processed is important in order to insure that down-stream functions and processing will properly occur. Any media that is mis-registered may not be properly printed with an indicia. This is a concern if it involves disbursement of money like a postage meter or franking device. In mailing machines, improper registration can mean a jam at the separator or conveyor station leading to the envelope moistener area of the machine. The present invention provides a way that insures that the media placed on the feeding deck of media processing equipment will be properly registered at its upper edge, where that edge is the key reference for accomplishing the desired next function in the equipment The present invention provides a way to immediately align the workpiece or media with the key registration wall, since the workpiece is pushed directly broadside into engagement with the registration wall. The mechanism disclosed herein additionally eliminates the need for structural guide components intended to cause the desired upper registration of the media.

DESCRIPTION OF THE INVENTION

Figure 1:
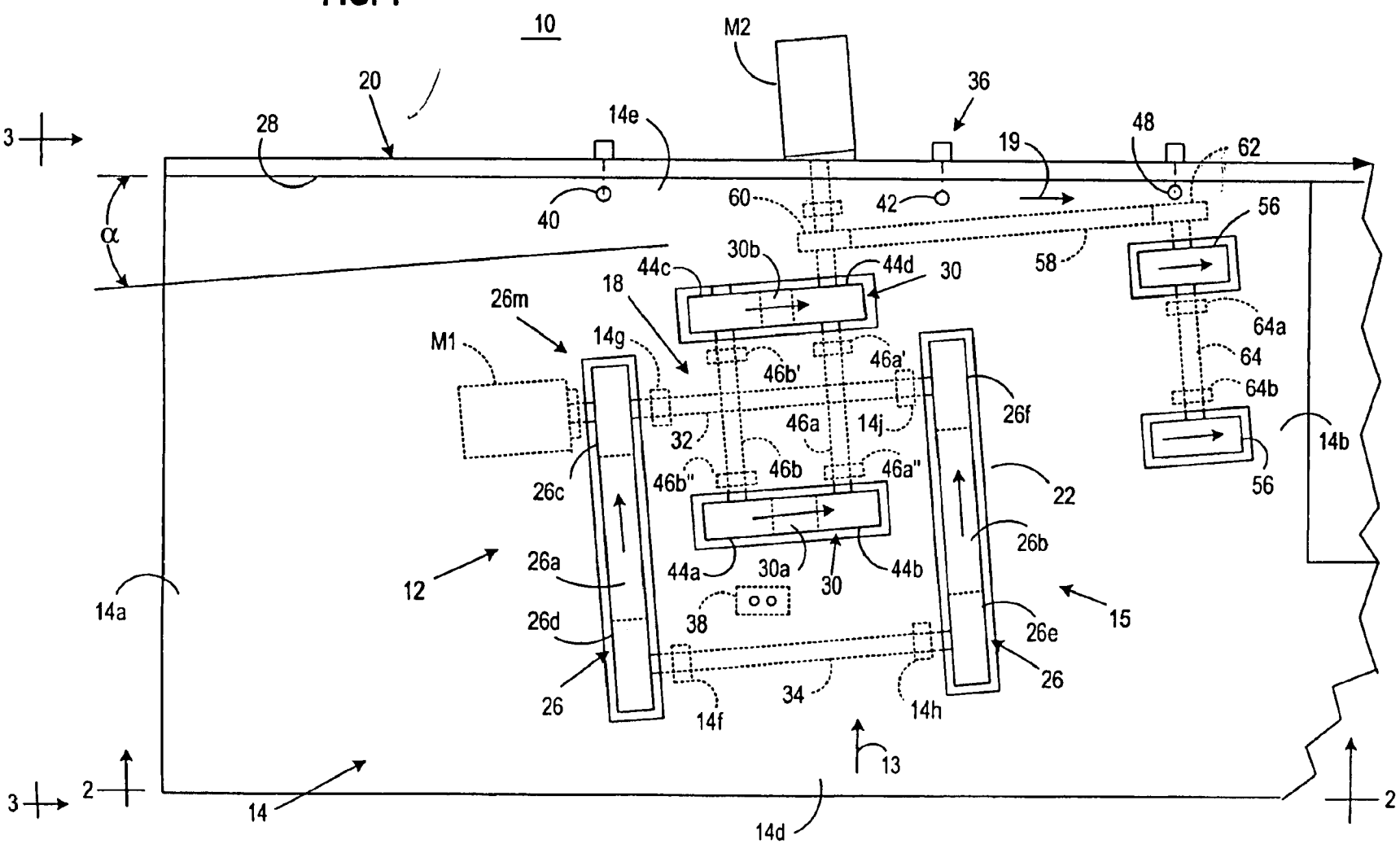
FIG. 1 is a partial plan view of a mailing machine with an input feeder illustrating the feeding apparatus of the present invention in an embodiment where the top surface of all conveying belts are of equal height above the feeding deck of the apparatus.

In FIG. 1 there is shown a partial plan view of an embodiment of the present invention including a document processing machine characterized as a mailing machine 10. The mailing machine 10 will represent a way to feed, register and advance media or articles in the form of envelopes using a feeding and advancing apparatus 12. The present invention can also be applied in document processing equipment that can feed other types of media such as paper, sheets, postcards, flat packages, flat mail, mail and so forth.

There is a horizontal input feeding deck 14 that may be slightly inclined towards a registration wall 28 to help the mail or envelopes register against a registration surface. The present invention is described here as having a generally horizontal attitude with respect to the feeding deck 14 and the associated feeding apparatus to be described. A prior art patent U.S. Pat. No. 5,044,452 to Rand et al for TILTED DECK MAIL HANDLING MACHINE elaborates on the benefits of having a sloped, inclined or slanted feeding deck. Feeding deck 14 generally supports and supports structure that feeds mail, envelopes, postcards, or other media from an upstream end 14*a,* to a downstream end 14*b* as such material is placed, deposited or thrown upon it. It will be recognized by those skilled in the art that the technology taught in the '452 reference may be applied to the present invention.

In the present description, the envelopes will be placed on the deck 14, which is oriented horizontally with respect to ground. Envelopes either singularly or in a stack will initially be fed in a first direction 13 from a front side 14*d* on the deck 14, to a rear side 14*e* by a first feeding apparatus 15 until registered against the wall 28. When the envelope or stack of envelopes are registered at the wall 28, feeding will then be towards the downstream end 14*b* by a second feeding apparatus 18 in a second direction 19.

The registration wall 28 is part of a machine structure 20 that the mailing machine 10 is built upon; structure 20 generally supporting electrical components, machine frames, motors and so forth. The feeding and advancing apparatus 12 will now be described in more detail in order to aid in understanding the assembly and functions of the present invention. The structure and assembly of the machine 10 includes the components of the feeding and advancing apparatus 12 that are fastened appropriately to a bottom side 14*c* of the input feeding deck 14 (See FIG. 2). In reference to the machine structure 20, there are associated moving feeding elements forming part of feeding and advancing apparatus 12, typically assembled to the structure of the bottom side 14*c* of the input feeding deck 14.

Figure 2:
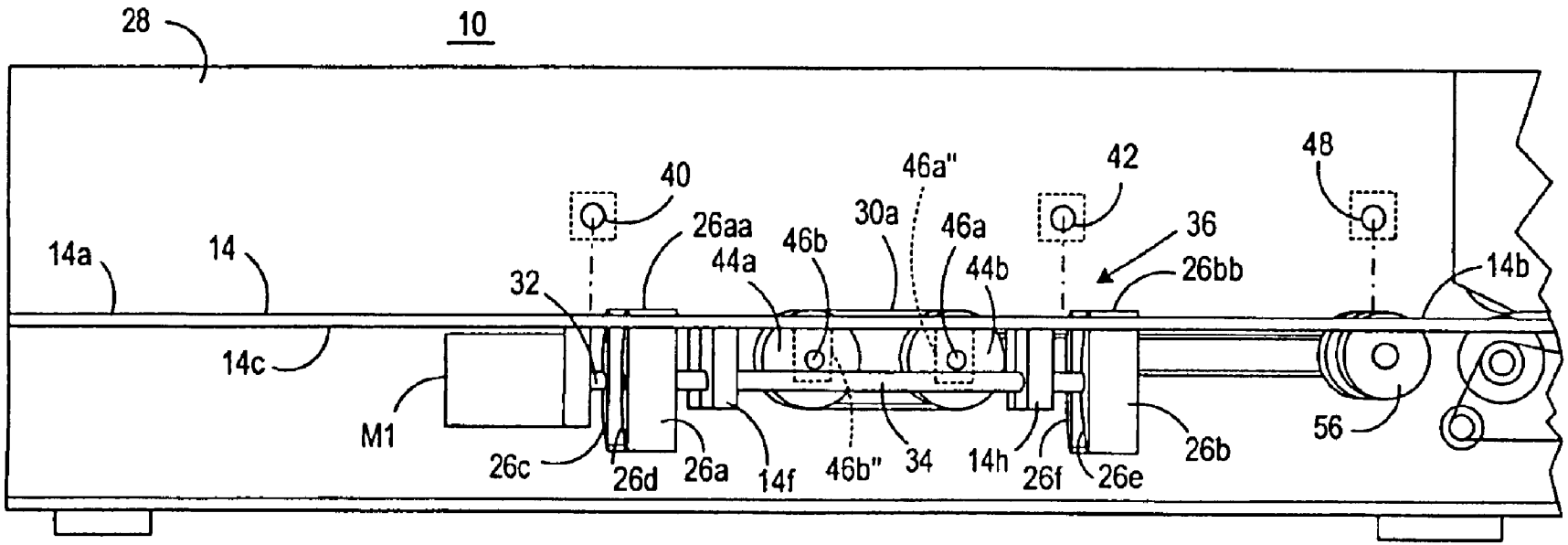
FIG. 2 is a front elevation view taken from FIG. 1, illustrating the feeding apparatus of the present invention.

Referring back to FIG. 1, included with the first feeding apparatus 15 there is a pair of conveying belts 26. The second feeding apparatus 18 includes a set of conveying belts 30. The conveying belts 26 and 30 are respectively mounted in the aforementioned structure 12 of the feeding deck 14. The pair of conveying belts 26 consists of an upstream belt 26*a,* and a downstream belt 26*b.* Referring now to FIG. 3, there is a front pulley 26*d,* and a rear pulley 26*c,* that support the upstream belt 26*a.* There is a front pulley 26*e,* and a rear pulley 26*f* supporting the downstream belt 26*b* (FIG. 2).

In FIG. 1, there is a front belt 30*a,* and a rear belt 30*b,* forming part of the second feeding apparatus 18. There is a front bearing block 14*f* and a rear bearing block 14*g,* both secured to the bottom surface 14*c* of the deck 14. There is a front bearing block 14*h* and a rear-bearing block 14*j* also secured to the bottom surface 14*c* of the deck 14. The block 14*j* and 14*g* support a rear pulley shaft 32 and the block 14*g* and 14*h* support a front pulley shaft 34. The first feeding apparatus 15 and the second feeding apparatus 18 is arranged such that the first feeding apparatus 15 is oriented in an orthogonal relationship to the second feeding apparatus 18. The second feeding apparatus 18 is oriented at an acute angle $\alpha$ with respect to the registration wall 28. The angle $\alpha$ may be varied from an angle of 6 degrees for feeding envelopes or mail to an angle more or less depending on the type of material to be fed. When placed on the feeding deck 14, the envelopes are fed initially along the first direction 13, become registered at the registration wall 28, and are then fed along the second direction 19 towards the downstream end 14*b,* and another processing station (conveyor, printer, envelope opener, etc).

There is a motor M1 directly mounted to the bottom side 14*c* of deck 14 (Details of mounting not shown). The motor M1 is connected to the shaft 32 of the first feeding apparatus 15. When a machine operator turns on a machine on/off switch (not shown) located on an operator panel (not shown), motor M1 immediately drives the pair of feeding belts 26. This may be substituted by a design or machine configuration where a reflective sensor 38, located in the deck 14 will sense an envelope, stack of envelopes, mail, or stack of mail or other material placed on the deck 14. A signal from the sensor 38 would initialize the machine 10, an associated control system then causing an automatic turn-on of the Motor M1, and other electromotive components. (An electronic control system connected to the Motor M1, and other electrical components would start the machine running upon receiving a material present signal in order to advance the envelope or material as desired). For the purposes of the present specification and clarification, that electronic control system is not shown or described in the present specification, but will be understood by those skilled in the art who may apply such as system to the present invention.

Figure 3:
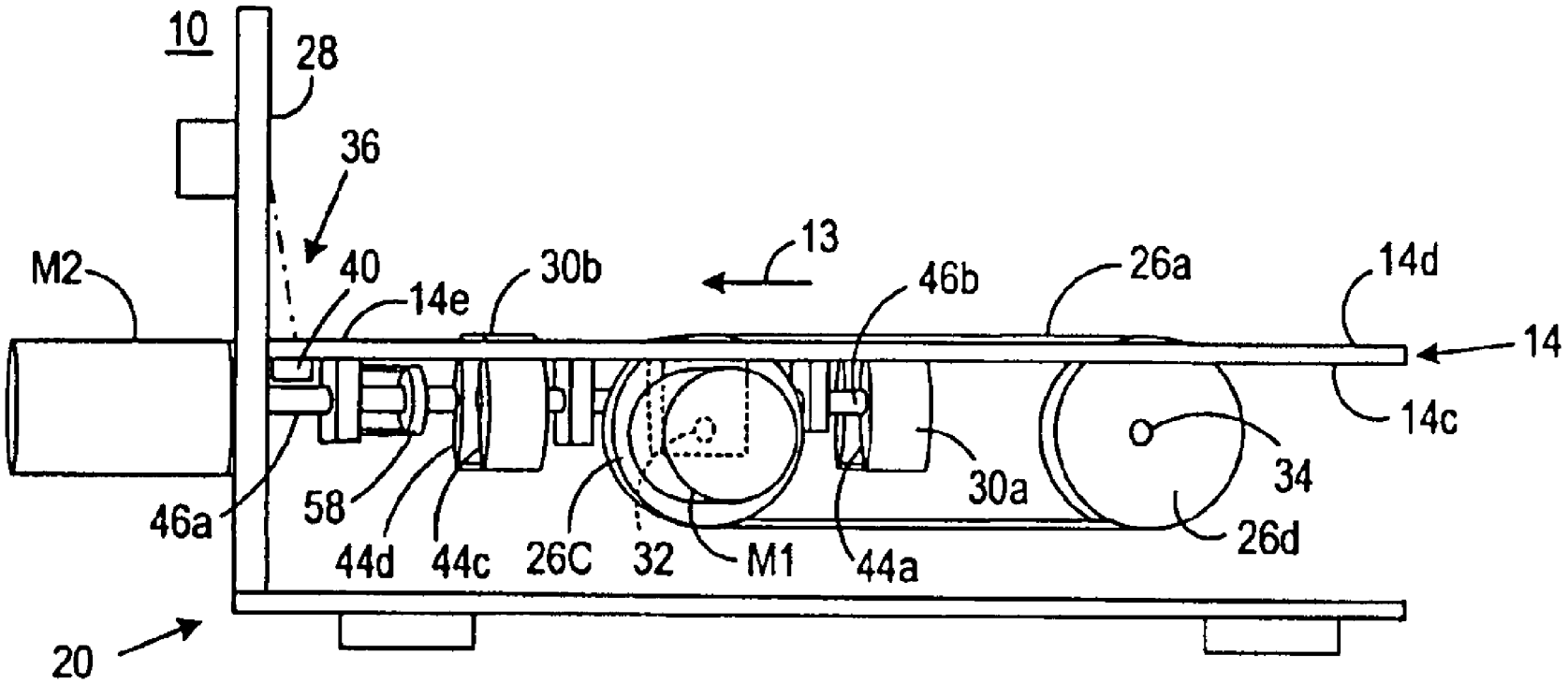
FIG. 3 is an end view of the embodiment of FIG. 1.

The moving pair of conveying belts 26 immediately advances the envelopes placed on the deck 14 towards the rear side 14*e* in the direction 13. The upper surface of the feeding belts 26 are above the deck 14 as shown in FIG. 2 and 3, in order to fully engage the envelopes or other material. An envelope, a stack of envelopes or other flat media may be indiscriminately thrown, or placed upon the deck 14 since the lateral feeding belts 26 will engage that material and propel it towards the registration wall 28. A sensing system 36 that includes a sensor 40 and sensor 42 that is positioned adjacent to the wall 28. Sensors 40 and 42 will detect the rear side of an envelope, a stack of envelopes, or other media instantly on arrival. It will be understood by those skilled in the art that the sensors shown in FIG. 1 and FIG. 2 is the type having a receptor and a light source. In this type of sensor, a passing article darkens the receptor and, a signal is generated and used accordingly such as in paper and envelope handling equipment.

The system is designed so that both sensors 40 and 42 detect a rear side of the material or envelope. If, for any reason only one sensor 40 or 42 is triggered, the material being advanced by the feeding belts 26 may not be properly registered. There will be a further discussion of this later in this specification. When both sensors 40 and 42 are triggered, the next feeding stage of this system starts as will be described next.

Referring to FIGS. 1, 2, and 3 once again, the pair of conveying belts 30 is seen supported by an upstream pulley 44*a,* a downstream pulley 44*b* for the belt 30*a,* and an upstream pulley 44*c,* and a downstream pulley 44*d* for the belt 30*b*. The pulleys 44*a,* and 44*b* for the belt 30*a* are in turn supported by an upstream shaft 46*b,* and a downstream shaft 46*a*. Shaft 46*a* is also directly connected to a motor M2, which is fastened to the registration wall 28 in a rear area 50 (details of assembly not shown). Supporting the Shaft 46*a* and 46*b,* there are a bearing block 46*a′,* a bearing block 46" and a bearing block 46*b′* and a bearing block 46*b″* respectively.

The belts 30*a* and 30*b* are normally below or parallel to a top surface 26*aa* and 26*bb* of the upstream belt 26*a,* and downstream belt 26*b* respectively. The belts 30*a* and 30*b* are synchronously started upon activation of the motor M2 when signaled by the control system (not shown), as activated by the appropriate signals from the sensors 40 and 42. At this same time, the motor M1 is de-activated, while the conveying belts 30 continue to move the aforementioned material downstream along the path defined as the second direction 19. The motor M1 will stay disengaged, and therefore the conveying belts 26 will not push the material towards the registration wall 28 unless a signal is generated by the sensors 40, 42, and a sensor 48, that is located slightly downstream in the second direction 19.

Referring back to FIG. 1, there is a spatial relationship of the pair of conveying belts 26 and the set of conveying belts 30 that supports the envelopes, mail, or other media placed on the feed deck 14. The spatial relationship may be altered or changed as desired to accommodate smaller or larger material than for example a number 10 envelope. Optimally, the spacing of the conveying belts to handle general envelope mail is a matter of choice and a dimension of inches between the pair of conveying belts 26, and inches between the set of conveying belts 30.

Referring to FIG. 1, the pair of conveying belts 26 are interlaced or interposed with the set of conveying belts 30 so that the pair of belts 30 are spatially straddled by (inside of) the set of belts 26. The spatial relationship is such that the upstream belt 26*a* and downstream belt 26*b* generally end (their physical driving surface) adjacent to the area of the rear belt 30*b*. Another way of describing this is that the rear belt 30*b* is located generally at a rearmost end (a back end, or a rear end) of the pair of belts 26. This spatial arrangement may be modified to suit the general physical space available on a feeding deck such as deck 14. Referring again to FIG. 1, the general plan arrangement of the pair of conveying belts 26 and the set of conveying belts 30 is substantially balanced for the present specification. It is entirely feasible to modify this arrangement in a number of ways that will adjust the placement of the feeding belts discussed above. For the present invention, and description of this embodiment, the set of belts 30 is centered between the pair of belts 26 when considering their layout from the upstream end 14*a* to the downstream end 14*b* of the feeding deck 14. The desired effect is support of an envelope, a stack of envelopes, or other media that may be fed along the feeding path in the first direction 13, and then the second direction 19 while registered along the registration wall 28.

Operation of the Feeding and Registration Apparatus

Figure 4:
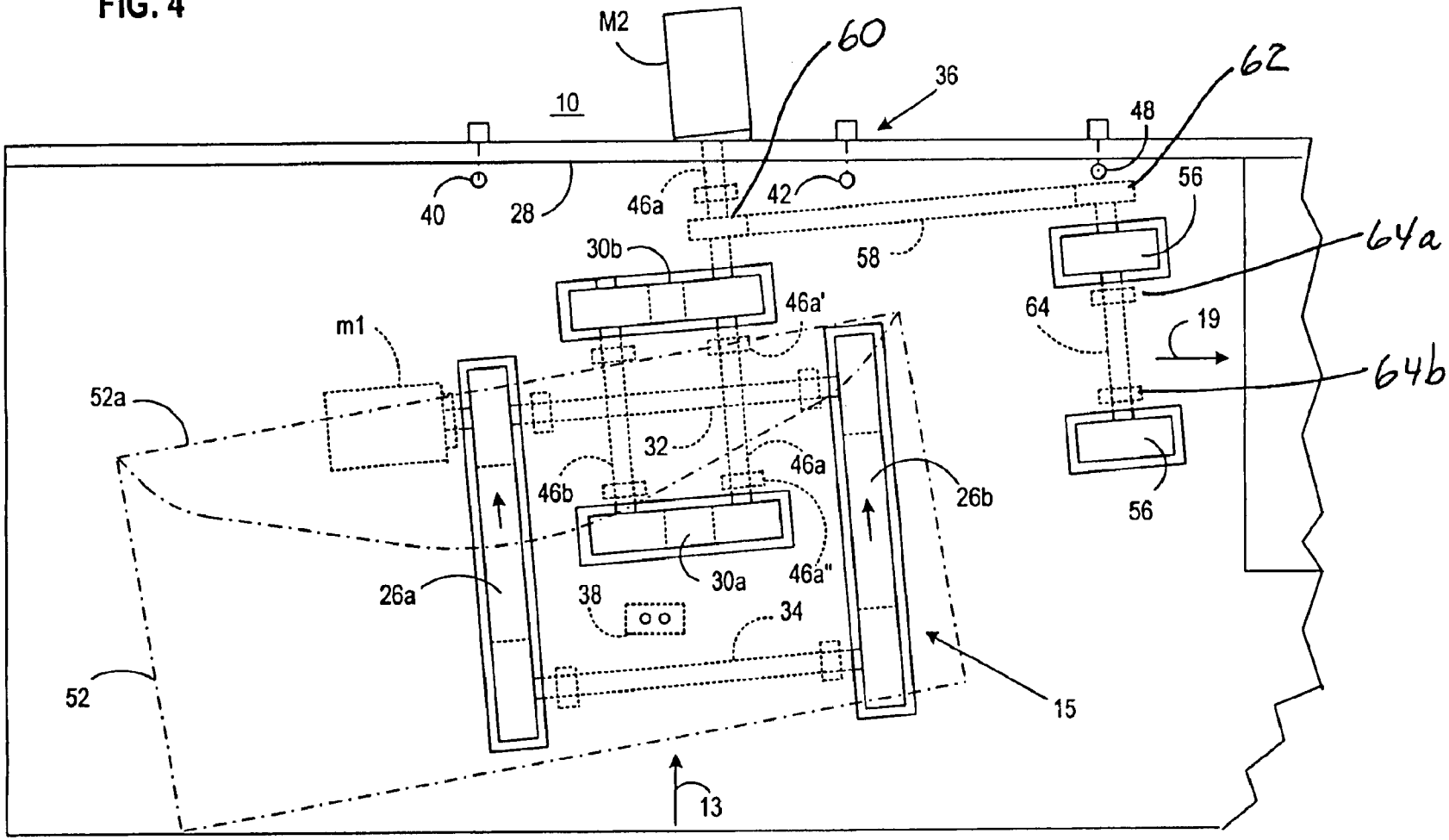
FIG. 4 is a plan view of the present invention taken along the same lines as FIG. 1, showing an envelope deposited on the feed deck.
Figure 4A:
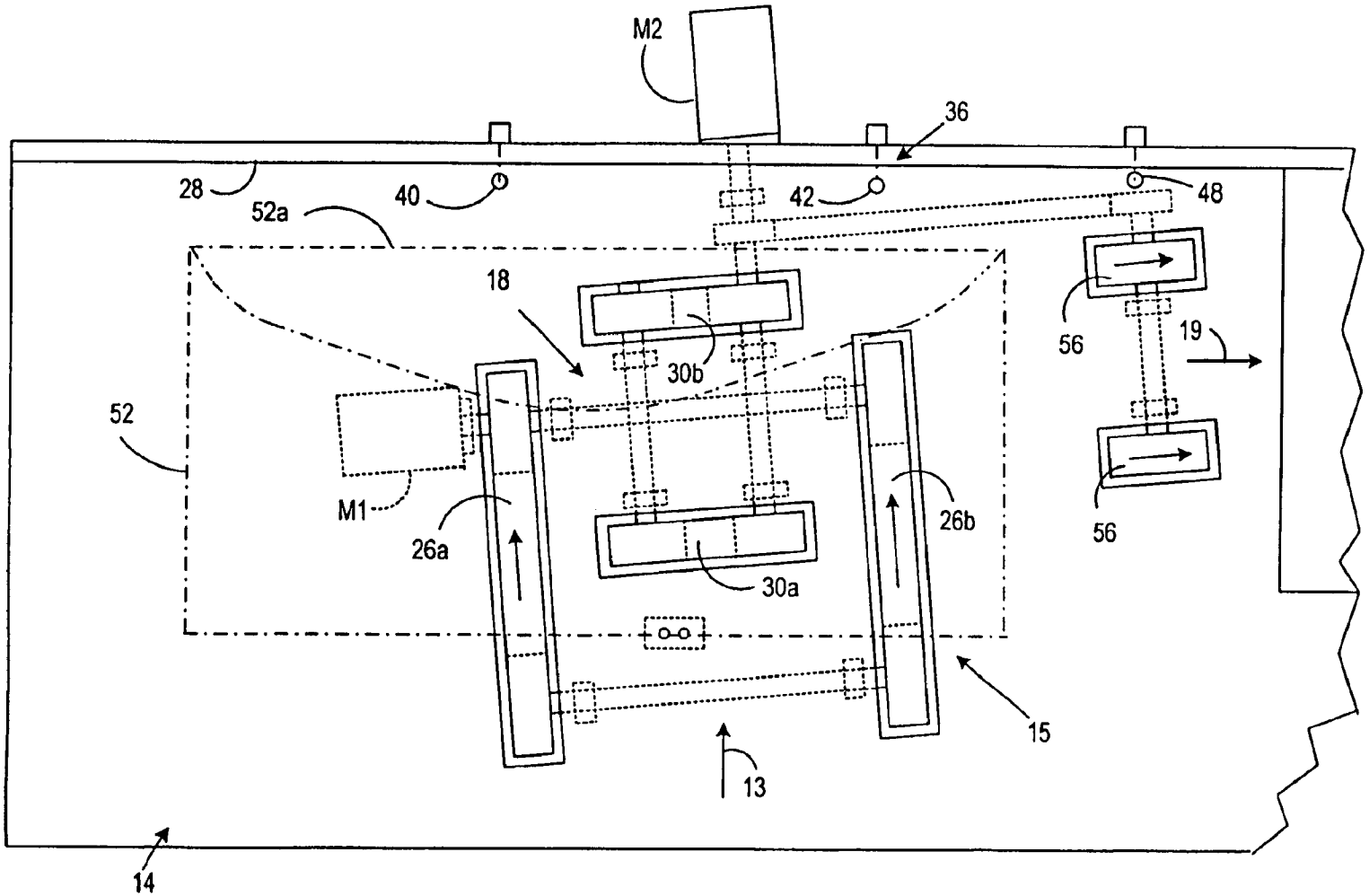
FIG. 4*a* is a plan view of the present invention taken along the same lines as FIG. 1 and FIG. 4, showing the envelope moved closer to the registration wall.

Referring now to FIGS. 4, 4*a,* 4*b* and 4*c,* the operation of a feeding cycle for an envelope 52 will now be described for the embodiment of FIG. 1. In FIG. 4, an envelope 52 is shown on the feeding deck 14 in a slightly skewed orientation with respect to the registration wall 28 (slightly skewed counterclockwise with respect to the registration wall 28). In the present invention, there generally is not a limiting angle that the material or envelope may be miss-aligned or skewed with respect to the registration wall. The only exception is that the skew is not at an angle that aligns a longer edge of the envelope or material with the feeding belts 26. The belts 26 must be able to turn the envelope or material so that a major side is going to end up in a parallel relationship with the wall 28. Generally the present feeding apparatus will handle a skew of up to 45 degrees, and it is entirely possibly given other types of material that a more severe skew would also be handled.

The objective in placing or throwing the envelope or mail on the deck 14 is that it be placed over the belt 26*a* and belt 26*b* as shown in FIG. 4. To help target this area, some simple marks can be provided on the feeding deck 14, within which an operator will "target" or aim for general placement of the material being fed (such marks are not shown but will be understood by those skilled in the art). The skew may be as shown skewed slightly to the left as shown in FIG. 4 (towards the upstream end 14*a,* or counterclockwise with respect to the registration wall 28), or the envelope 52 may be skewed clockwise with respect to the registration wall 28. In either case, the conveying belts 26 will advance the envelope 52, or other material towards the registration wall 28.

Figure 4B:
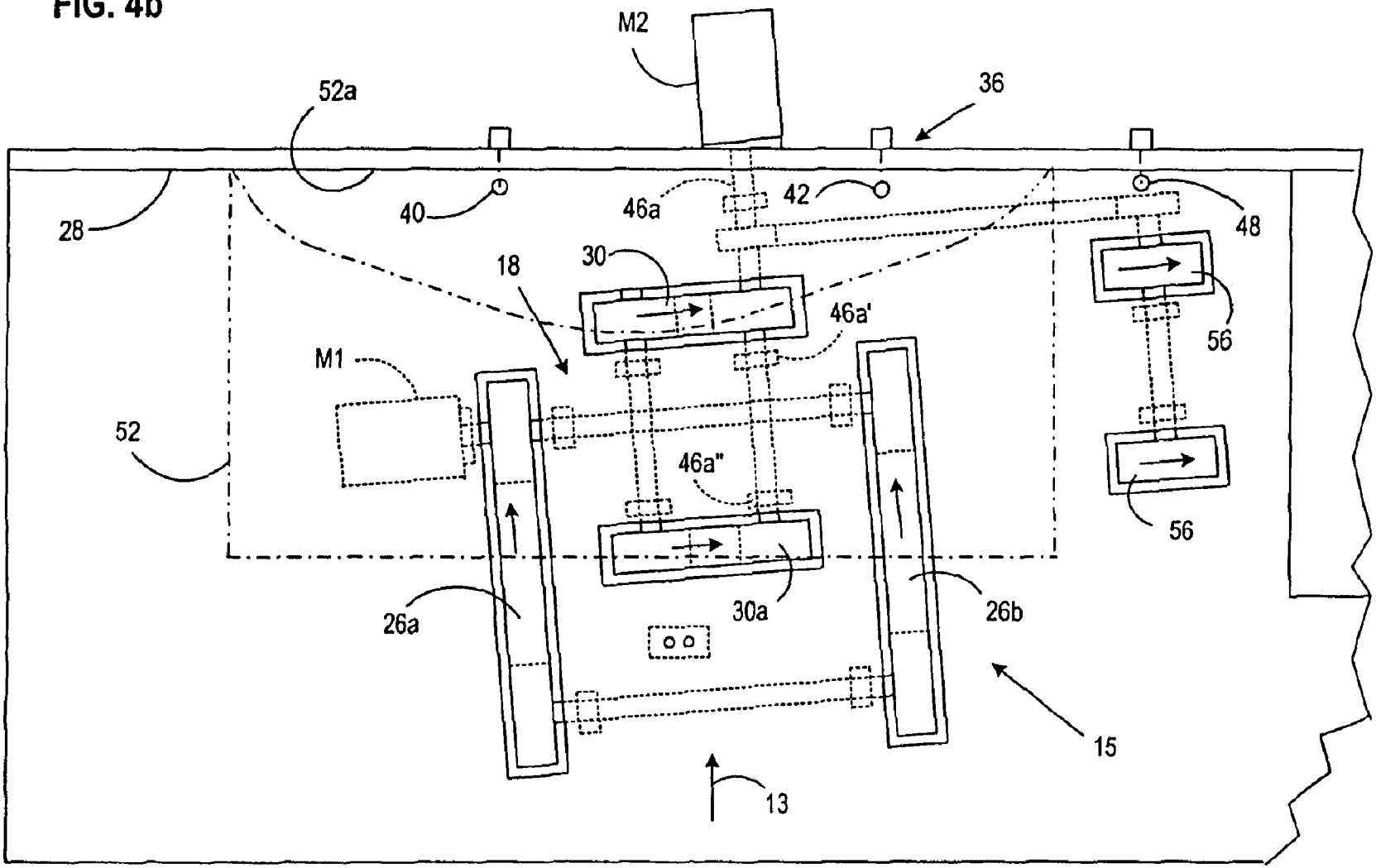
FIG. 4*b* is a plan view of the present invention taken along the same lines as FIG. 4*a,* showing the envelope registered at the wall, and being advanced downstream in the second direction.
Figure 4C:
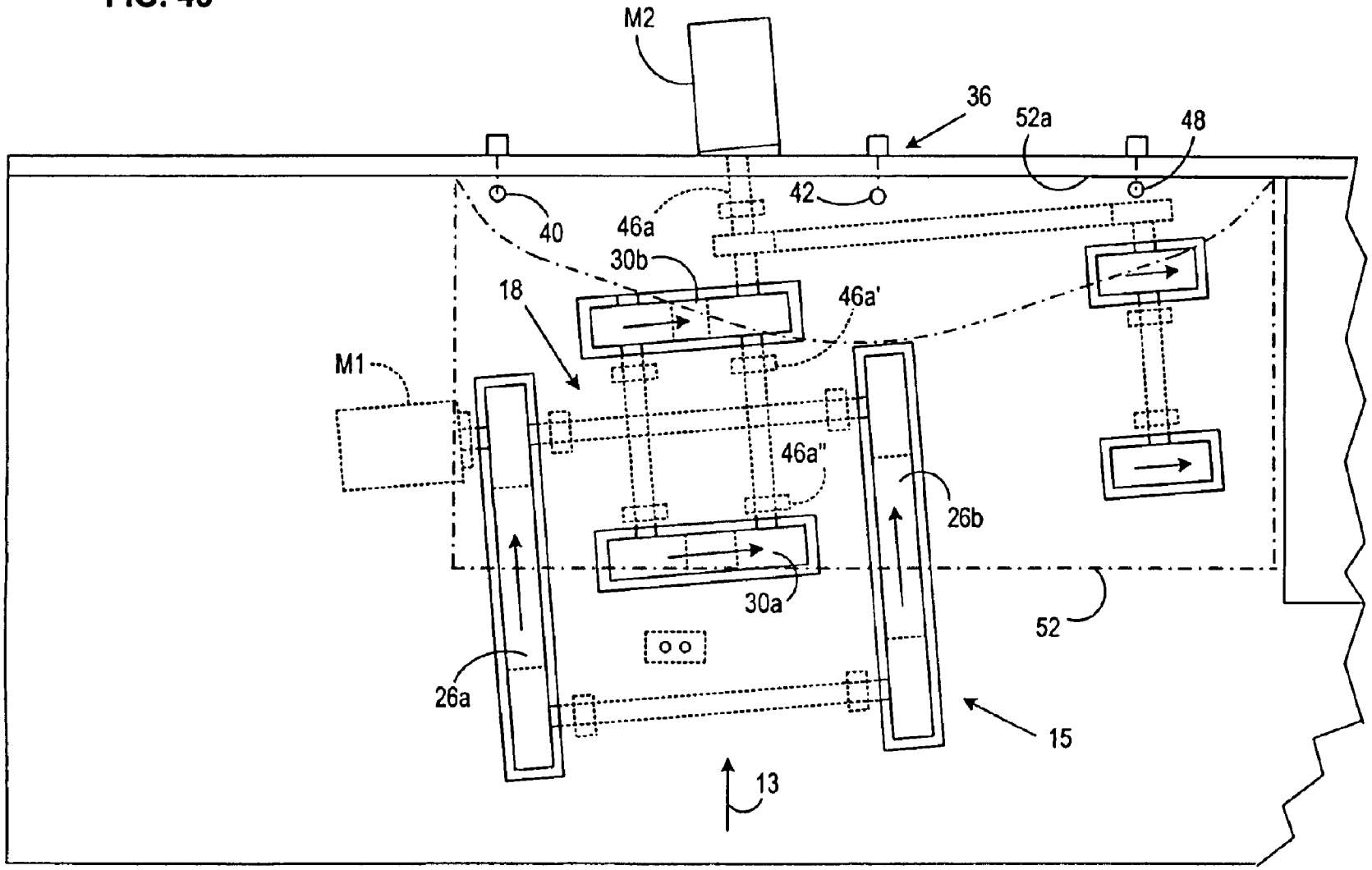
FIG. 4*c* is a plan view of the present invention taken along the same lines as FIG. 4*b,* showing the envelope advanced in the downstream direction.

In FIG. 4*a,* the envelope 52 is shown moving towards the registration wall 28, under influence of the lateral feeding belts 26. In FIG. 4*a,* a rear edge 52*a* of the envelope 52 (the flap side) is shown in position as it is in moving towards the wall 28. At this time, the conveying belts 30*a,* and 30*b* are disengaged from feeding the envelope 52 in the second direction 19 (motor M2 is not enabled). In FIG. 4*b,* the envelope 52 is seen fully registered at the registration wall 28. At this time, the sensors 40 and 42 detect the rear edge 52*a* and the motor M2 is energized. The set of conveying belts 30 are now engaging the envelope 52, pushing it towards the downstream end 14*b* (direction 119). The envelope will be picked up and transported by a pair of conveying rollers 56 that are driven by a belt 58 connected to the downstream shaft 46*a*. A timing pulley 60 on the shaft 46*a* supports the belt 58 at the upstream end, and a pulley 62 is mounted on a shaft 64, the shaft 64 being supported on a bearing block 64*a,* and a bearing block 64*b.* The bearing blocks 64*a* and 64*b* are fastened to the bottom side 14*c* of the deck 14. The pair of conveying rollers 56 push the envelope 52 along the feeding deck 14 to the next processing station located downstream. The rollers 56 may be substituted by any number of conveying devices available in the field, including an upper/lower pair of rollers, a pair of conveying belts, brushes, a vacuum conveyor, etc, (all of which are not shown or demonstrated in the present specification).

If, at any point in the conveyance of the envelope 52 the edge 52*a* becomes miss-registered, the motor M1 is enabled, and the pair of conveying belts 26 engage the envelope once again to re-register the envelope edge 52*a* against the registration wall 28. While this occurs, the motor M2 is de-energized, until re-registration of the envelope 52 occurs.

Description of Alternate Embodiment I

Figure 5:
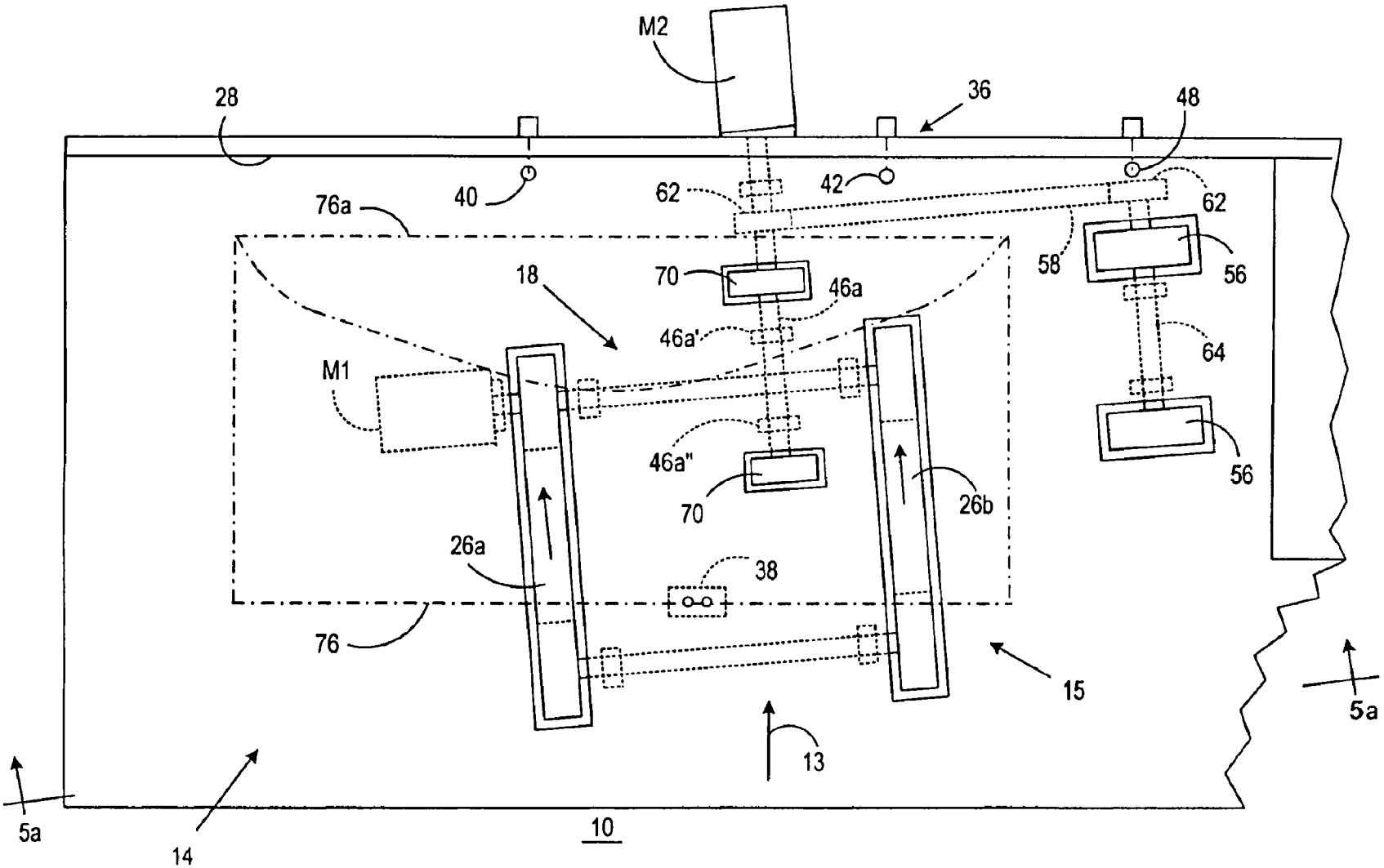
FIG. 5 is a plan view of an alternate embodiment I of the present invention that utilizes a pair of conveying belts and a pair of feeding rollers to advance material downstream in the apparatus.
Figure 5A:
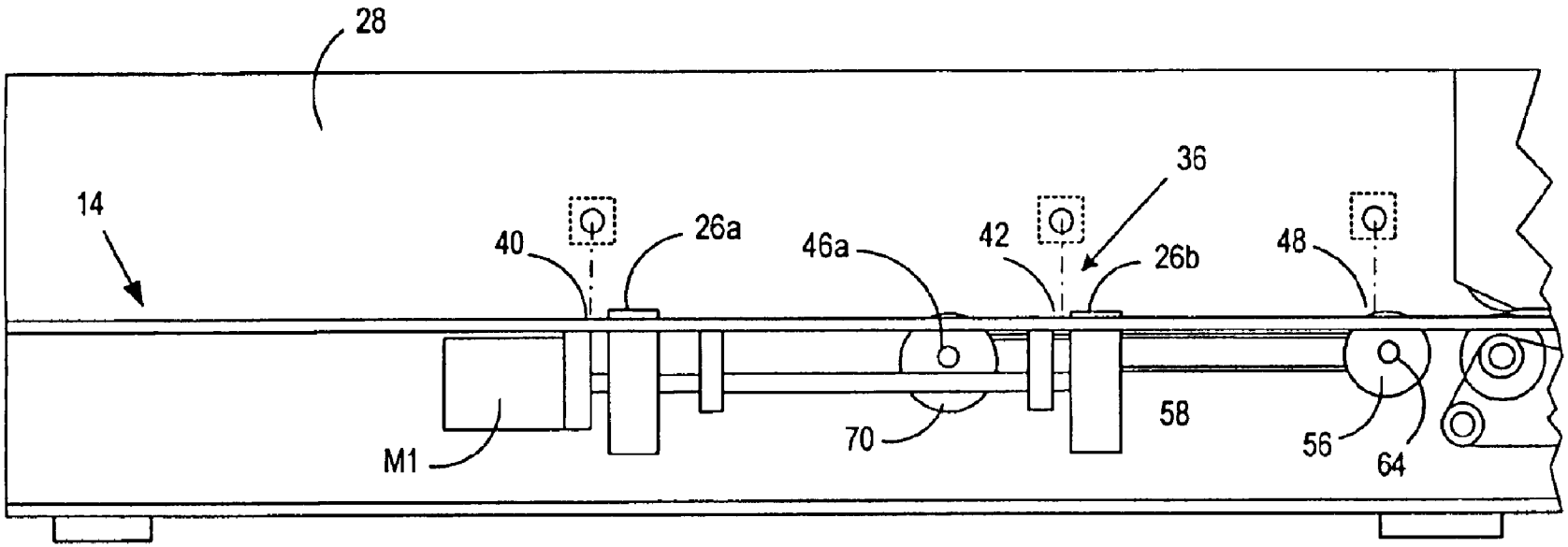
FIG. 5*a* is a front elevation view taken along the lines 5*a*—5*a* in FIG. 5.

Referring to FIG. 5, there is shown a plan view of an alternate embodiment I to the present invention. The basic structure previously defined in reference to the mailing machine 10 remains the same as that disclosed in reference to FIG. 1 and that associated embodiment, with the following exception. There is provided a pair of feeding rollers 70 mounted on the shaft 46*a,* as a substitute for the conveying belts 30. The rollers 70 are mounted on the shaft 46*a,* which is supported by the bearing block 46*a'* and 46*a".* With this configuration, the rollers 70 will be the pushing force for an envelope 76, after a side edge 76*a* (flap side) is registered along the registration wall 28. Similar to the previous embodiment disclosed in FIG. 1, the motor M2 will be turned on when the sensors 40 and 42 are enabled. Conveyance of the envelope 76 will continue by the rollers 70 as long as the envelope 76 remains registered at the wall 28. If at any time any of the sensors 40, 42, or 48 are uncovered, the motor M1 will be enabled to cause re-registration by the set of conveying belts 26. The motor M2 would be disabled until re-registration occurs once again.

Description of Alternate Embodiment II

Figure 6:
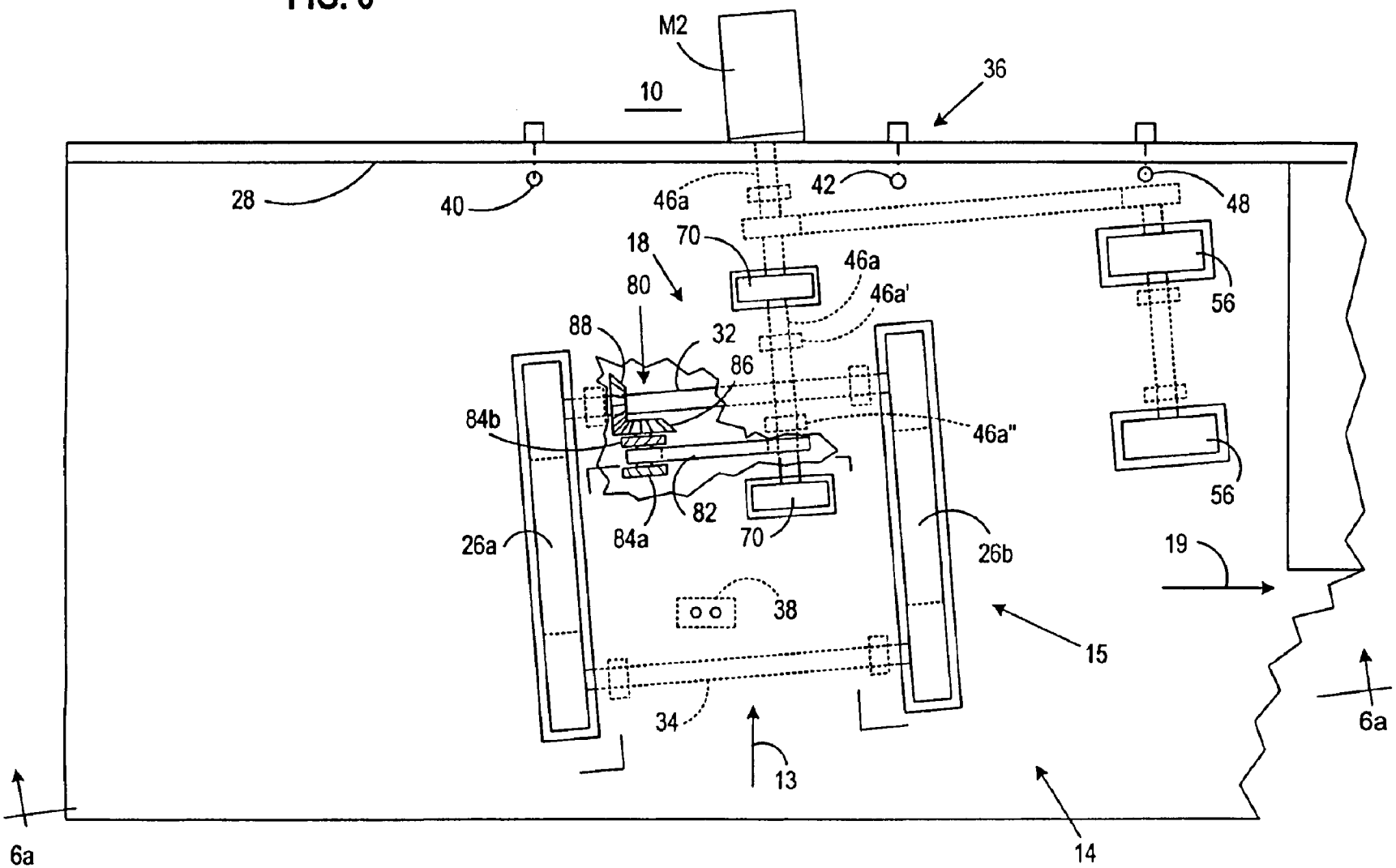
FIG. 6 is a plan view of an alternate embodiment II of the present invention that utilizes a single drive motor and a miter gear drive to drive the conveying belts and feeding rollers shown in FIG. 5.
Figure 6A:
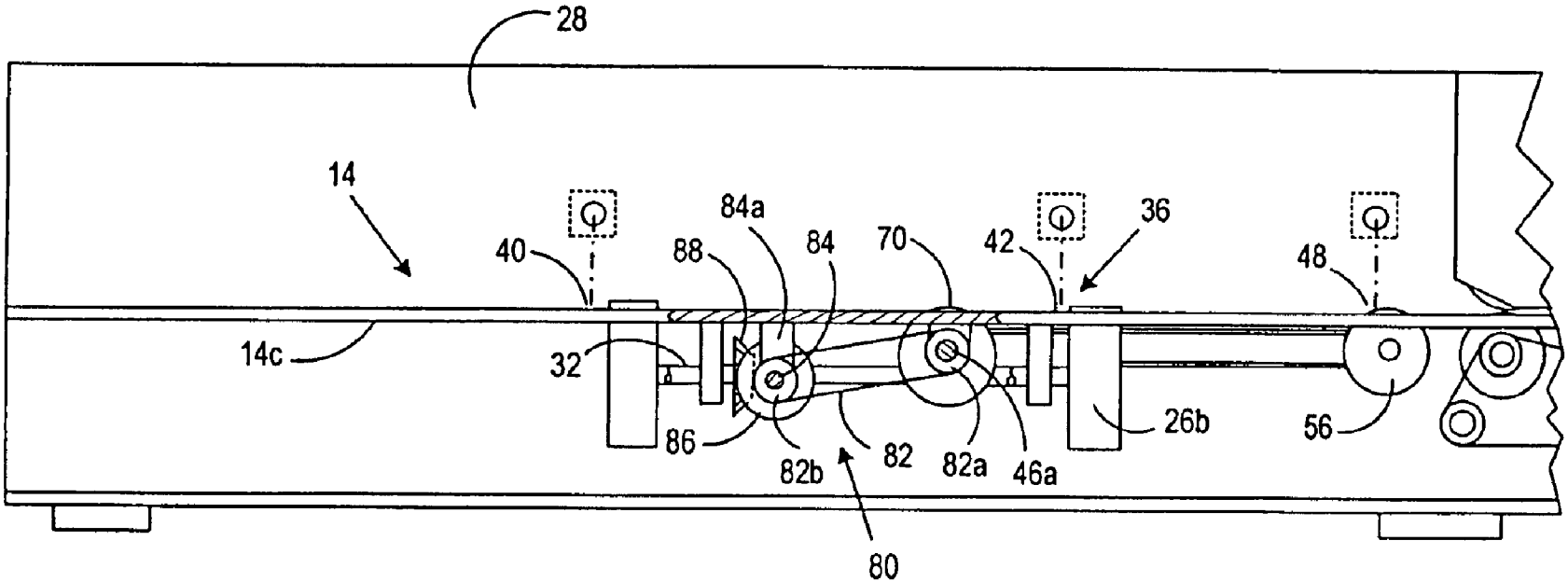
FIG. 6*a* is a front elevation view taken along the lines of FIG. 6.

Referring to FIG. 6, and FIG. 6*a,* there is shown a plan view and a front elevation view of an alternate embodiment I to the present invention. The basic structure previously defined in reference to the mailing machine 10 remains the same as that disclosed in reference to FIG. 1 and that associated embodiment, with the following exceptions.

There is provided a miter gear drive 80, consisting of a belt 82, mounted on a pulley 82*a,* the pulley 82*a* being mounted on the drive shaft 46*a* of the embodiment disclosed in FIG. 1. The belt 82 is supported on an output shaft 84. Shaft 84 is supported in a bearing block 84*a* and 84*b,* both of which are secured to the bottom side 14*c* of the feeding deck 14. There is a first miter gear 86 attached to the output shaft 84, and a second miter gear 488 attached to the rear pulley shaft 32 of the embodiment in FIG. 1.

Embodiment II is designed to feed the articles laterally towards the registration wall 28 and downstream along the second direction 19 simultaneously. The motor M2 is the principal drive source in this, embodiment and is connected directly to the pair of feeding rollers 70 and indirectly to the pair of conveying belts 26 (26*a,* 26*b*). When a main power switch is on, the system will automatically begin feeding an article, an envelope, a stack of envelopes or mail placed on the feeding deck 14 towards the registration wall 28. The envelope or material will become registered at the wall 28, and will then be fed along the feeding deck 14 in the second direction 19. The sensors 40, 42 and 48 will see the edge of such material as being properly registered. Any situation where one or more of the sensors are not covered will cause the feeding apparatus to stop. The mailing machine 10 may be programmed a number of different ways, one of which is to turn off the motor M2, and alert the operator through a display that would As indicate a miss-registration, miss-alignment or miss-register of the envelope or article has occurred. Another way of handling a miss-registration with this embodiment is to jog the drive, so that alternatively, the articles will be jostled and will eventually be registered. Experience has shown that the system as described for embodiment II will properly register such material, eliminating further activity by the machine operator.

Description of Alternate Embodiment III

Figure 7:
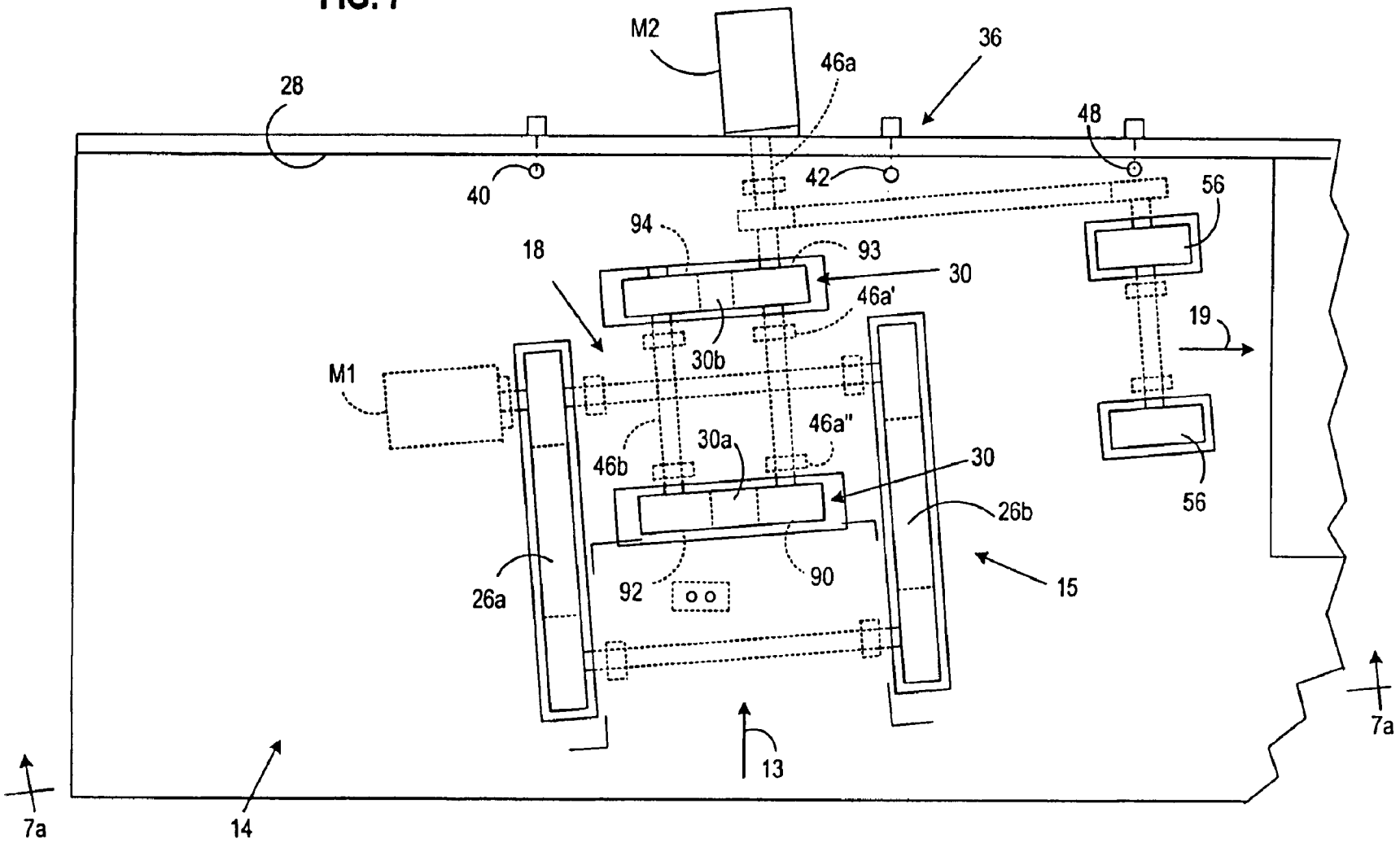
FIG. 7 is a plan view of an alternate embodiment III of the present invention that utilizes pairs of eccentric pulleys to support the set of conveying belts in the second feeding apparatus.
Figure 7A:
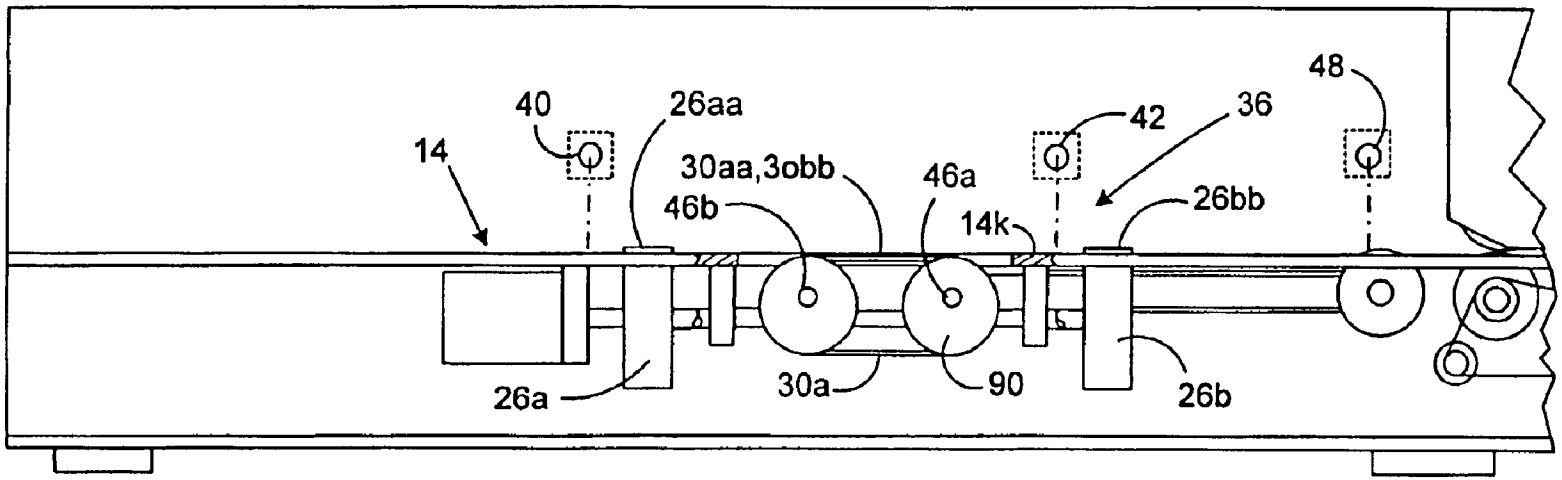
FIG. 7*a* is a front elevation view taken along the lines of FIG. 7.
Figure 7B:
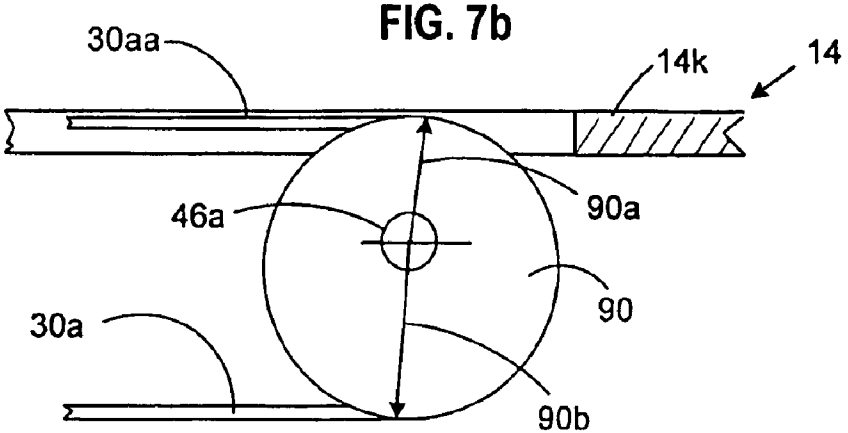
FIG. 7*b* is a slightly enlarged view taken along the lines of FIG. 7*a,* showing the detail of an eccentric pulley of the alternate embodiment III.

Referring to FIG. 7 and FIG. 7*a,* there is shown a plan view and an elevation view of an alternate embodiment III of the present invention. There is an arrangement along the same structural configuration of the embodiment disclosed and drawn with reference to FIG. 1 with one principal exception. Referring to the elevation view in FIG. 7*a,* and a slightly enlarged view of FIG. 7*b,* there is an eccentric pulley 90 shown. There are four pulleys all together, eccentric pulleys 90, 92, 93 and 94, all attached to the appropriate mounting shafts 46*a,* and 46*b.* The eccentric pulleys 90,92, 93 and 94 take the place of the pulleys shown and referred to in the embodiment discussed in FIG. 1. Referring to FIG. 7*b,* the eccentric design of the eccentric pulley 90 is seen, with a minor radius 90*a,* and a major radius 90*b.* The minor radius 90*a* is shown at an elevation equal to topside 14*k* of the feeding deck 14. The minor radius 90*a* is below the upper conveying surfaces of the pair of conveying belts 30*a* and 30*b.* Each eccentric pulley 90, 92, 93 and 94 are in synchronization with each other so that a top surface 30*aa,* and 30*bb* of the conveying belts 30*a* and 30*b* rise upwards together upon rotation of the motor M2, attached shaft 46*a,* and all attached pulleys 90,92,93 and 94.

This action will be carried out upon the proper registration of an envelope, stack of envelopes, an article, or stack of articles, etc at the registration wall 28. The sensors 40, 42 will detect the registration as described in the preceding specification in reference to the embodiment in FIG. 1. When the registration is detected, the motor M2 is enabled, and the set of conveying belts 30 rise up and engage the bottom surface of the envelope, etc, and carry it downstream towards the direction 19. If any sensor 40, 42 or 48 detects miss-registration, the motor M1 is enabled to carry the envelope, etc to the registration wall 28 as previously discussed in reference to the embodiment of FIG. 1. One of the advantages of this embodiment is that the upper conveying surfaces of the set of conveying belts 30 are normally below or parallel to the topside 14*k* of the feeding deck 14. This means that a broad edge of the envelope, mail, etc will not strike the edge of the belts 30 when the pair of conveying belts 26 are moving that material towards the registration wall 28.

Alternate Embodiment IV

Figure 8:
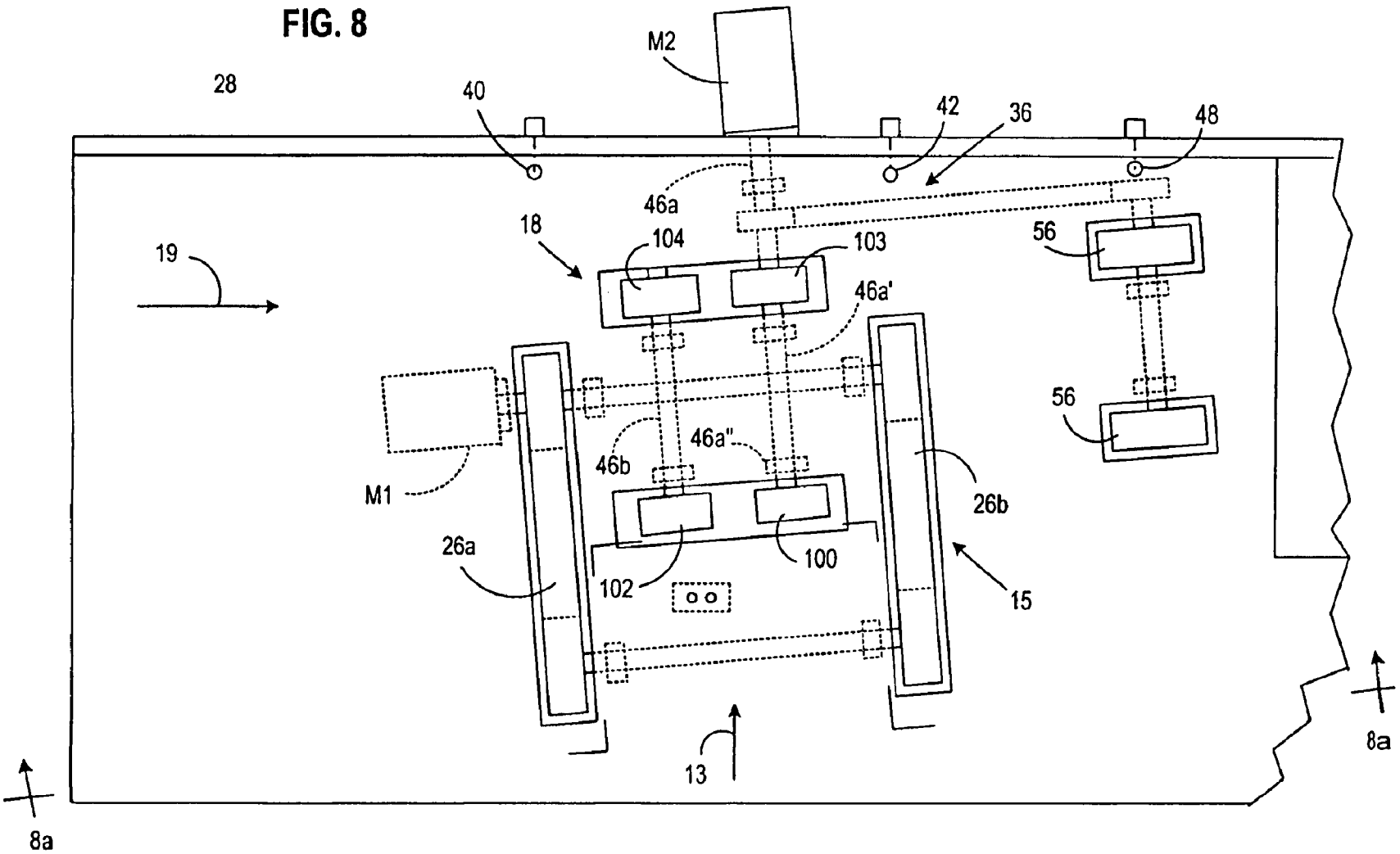
FIG. 8 is a plan view of an alternate embodiment IV of the present invention that utilizes pairs of eccentric rollers in the second feeding apparatus.
Figure 8A:
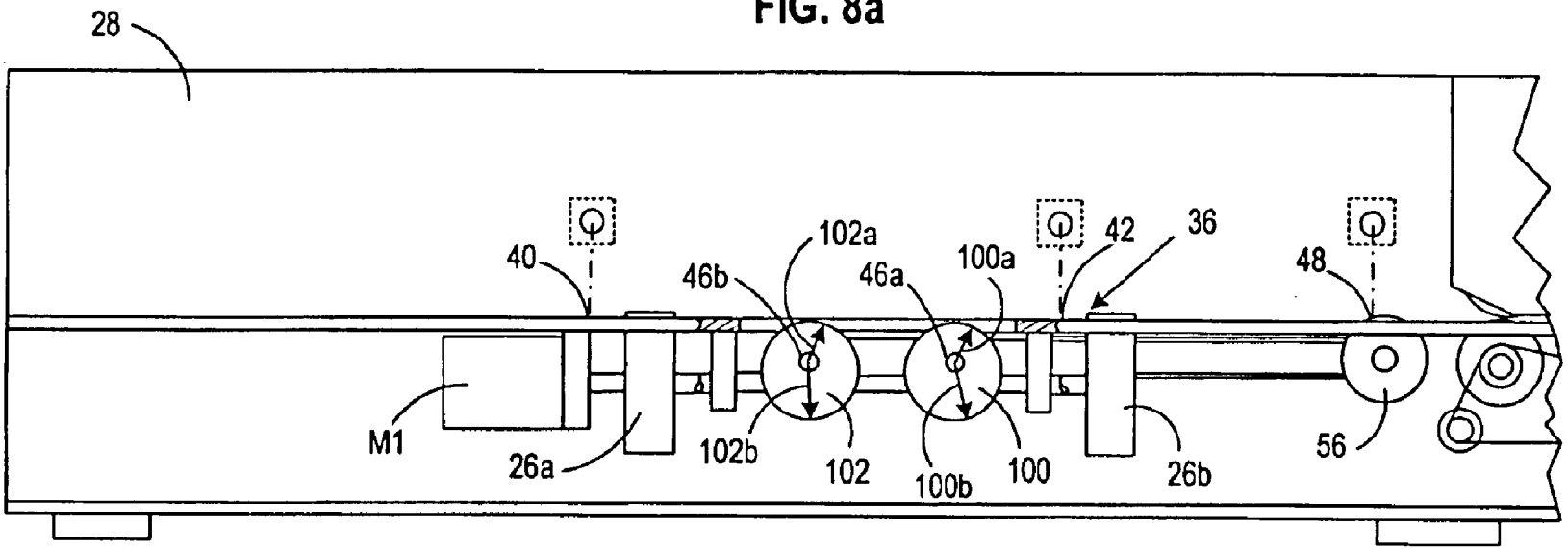
FIG. 8*a* is a front elevation view taken along the lines of FIG. 8.

Referring to FIG. 8 and FIG. 8*a,* there is shown a plan view and an elevation view of an alternate embodiment IV of the present invention. In FIG. 8 there is an arrangement along the same structural configuration of the embodiment disclosed and drawn with reference to FIG. 7 with the exception that there is not any set of conveying belts included in the design. The eccentric pulleys previously discussed with reference to the embodiment III have been replaced with an eccentric roller 100, 102, 103 and 104, all serving the same purpose as defined in embodiment III. An article, envelope, or stack of envelopes will be held above the feeding deck 14, and pushed towards the registration wall 28 without contacting a minor radius 100*a* or a minor radius 102*b* of the roller 100 and 102 respectively. (The other rollers 103, and 104 are configured similarly).

The functionality of embodiment IV is the same as that described for the embodiment of FIGS. 1 and 7 in that an envelop, a stack of envelopes, an article etc, will be pushed towards the registration wall 28, and registered when detected by the sensors 40, and 42. This will enable the motor M1, and the eccentric rollers, (sometimes called bump wheels), will then rise upon rotation of the shaft 46*a* thereby causing a major radius 100*b*, 102*b*, 103*b* and 104*b* of the rollers 100, 102, 103, and 104 to engage the bottom surface of the envelope, article, stack of articles, etc. to effect a jog of the articles etc towards the downstream direction 19. If, any of the sensors 40, 42 or 48 do not detect an edge of the material being registered at any time (miss-registration, etc.), the motor M1 will be enabled, and the motor M2 disabled until such registration occurs. The motor M1 is activated to re-feed the articles, etc towards the registration wall 28, and to detection by the sensors 40, 42 or 48. This cycle will continue until the material is properly advanced to the desired downstream function.

Figure 8B:
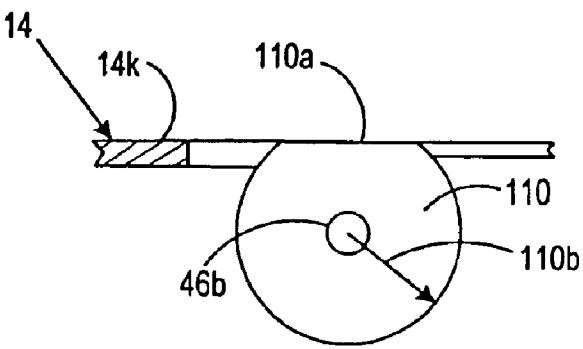
FIG. 8*b* is a slightly enlarged view taken along the lines of FIG. 8*a,* of an alternate second feeding apparatus element that may be utilized in the FIG. 8*a* configuration.

With reference to embodiment IV, and FIG. 8*b*, a substitution may be made of the eccentric rollers 100, 102, 103 and 104. In FIG. 8*b*, there is shown a flatted roller 110. A flat 110*a* on the roller 110 (used as many times as is desired) can be aligned with the top side 14*k* of the feeding deck 14 (or be slightly below it), in order to provide a similar bump feeding function defined with reference to the eccentric rollers 100–104. A radius 10*b* will engage the material upon rotation of the shaft 46*b*, which is a satisfactory alternative.

Figure 8C:
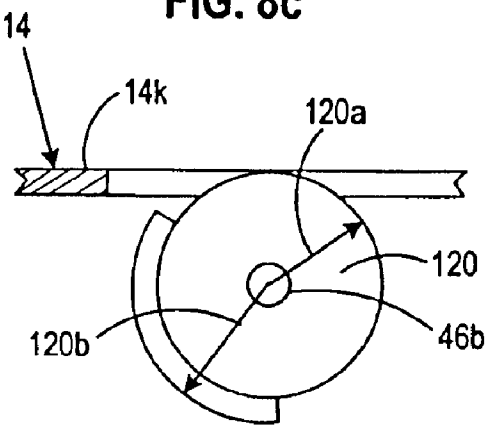
FIG. 8*c* is a slightly enlarged view taken along the lines of FIG. 8*a,* of an alternate second feeding apparatus element that may be utilized in the FIG. 8*a* configuration.

With reference to embodiment IV, and FIG. 8*c*, another substitution may be made of the eccentric rollers 100–104, or the flatted roller 110. In FIG. 8*c*, a segmented roller 120 is shown with a radius 120*a*, and a segmented section 120*b*. The radius 120*a* is at a level that is equal to or below the top side 14*k* of the feeding deck 14, and the segmented section 120*b* will engage the material upon rotation of the shaft 46*b*, another satisfactory alternative to the prior conveying apparatus disclosed.

Alternate Embodiment V

Figure 9:
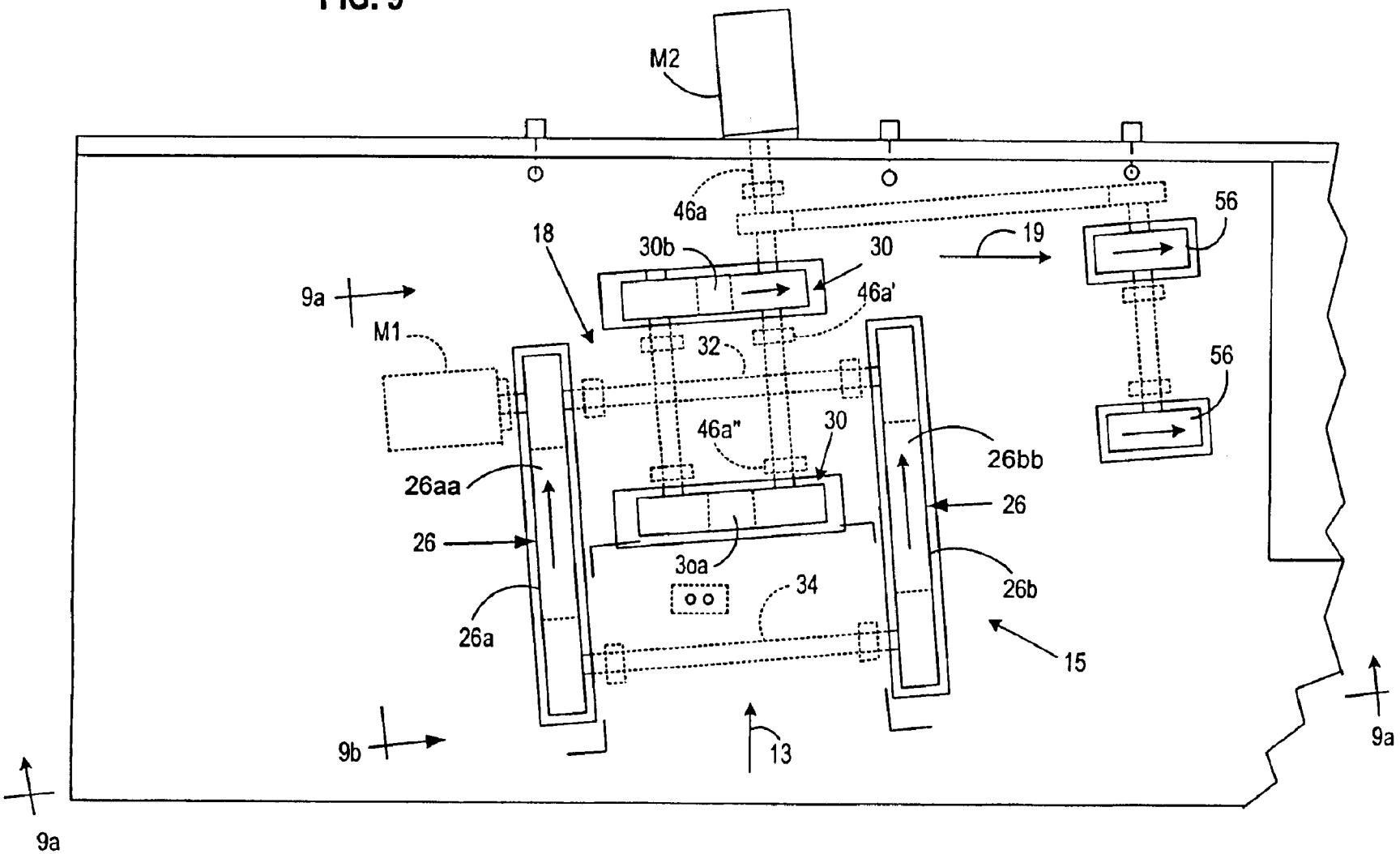
FIG. 9 is a plan view of an alternate embodiment V of the present invention that utilizes a feeding and conveying design similar to that shown in FIG. 7, (alternate embodiment III), with the pair of (input) conveying belts of the first feeding apparatus slightly inclined towards their respective output ends.
Figure 9A:
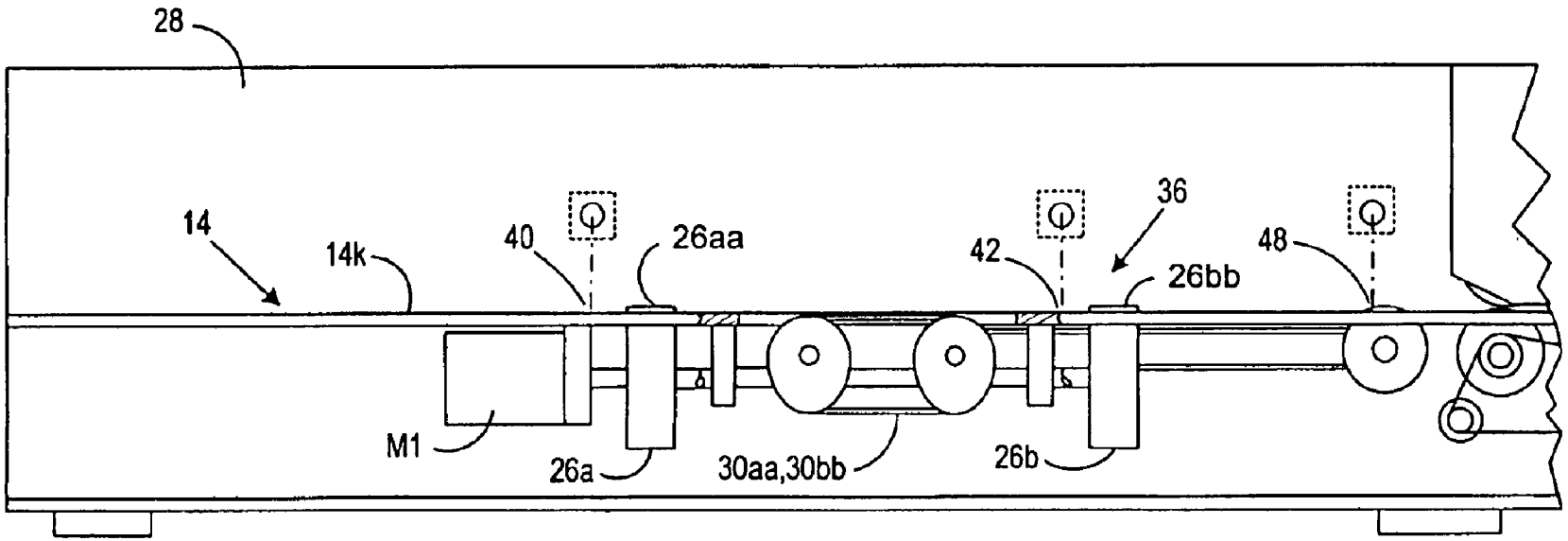
FIG. 9*a* is an elevation view taken along the lines of FIG. 9.
Figure 9B:
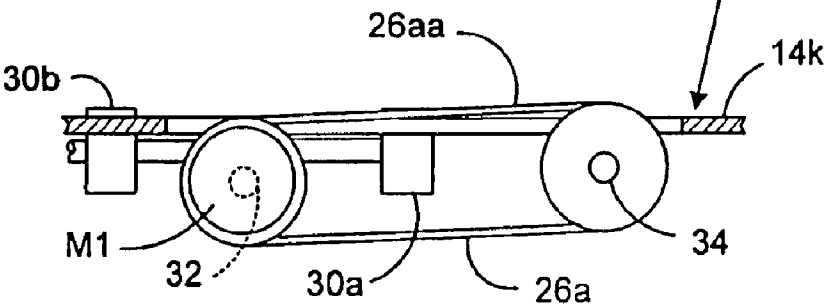
FIG. 9*b* is an end view taken along the lines of FIG. 9.

Referring to FIG. 9 and FIGS. 9*a* and 9*b*, there is shown a plan view and an elevation view of an alternate embodiment IV of the present invention. In FIG. 9 there is an arrangement along the same structural configuration of the embodiment disclosed and drawn with reference to FIG. 7. The only difference is that the shaft 32 is lower than shaft 34 with respect to the feeding deck 14, in order to give a slight downward grade or decline to the pair of conveying belts 26. The rear side of the belts 26*a* and 26*b* are lowered to the point that their top surfaces 26*aa*, and 26*bb* are parallel to or below the topside 14*k* of the feeding deck 14. This arrangement will provide an additional slight advantage of gravity with the registration of articles or material against the registration wall 28.

The design of the eccentric pulleys 90, 92, 93 and 94 disclosed in the embodiment III in FIG. 7, etc is the same, and the belts 30*a* and 30*b* are supported on those eccentric pulleys in the same manner. Material such as an envelope, an article, a stack of articles, etc, are advanced as before by the pair of conveying belts 26, with a slight downward path as defined above with reference to the lower shaft 32. The material once again will register against the registration wall 28, and be carried forward in the direction 19 when the motor M2 is enabled. The same cycle of re-feed from the conveying belts 26 will occur upon miss-registration, and the cycle will continue as defined in the FIG. 7 configuration and embodiment.

Alternate Embodiment VI

Figure 10:
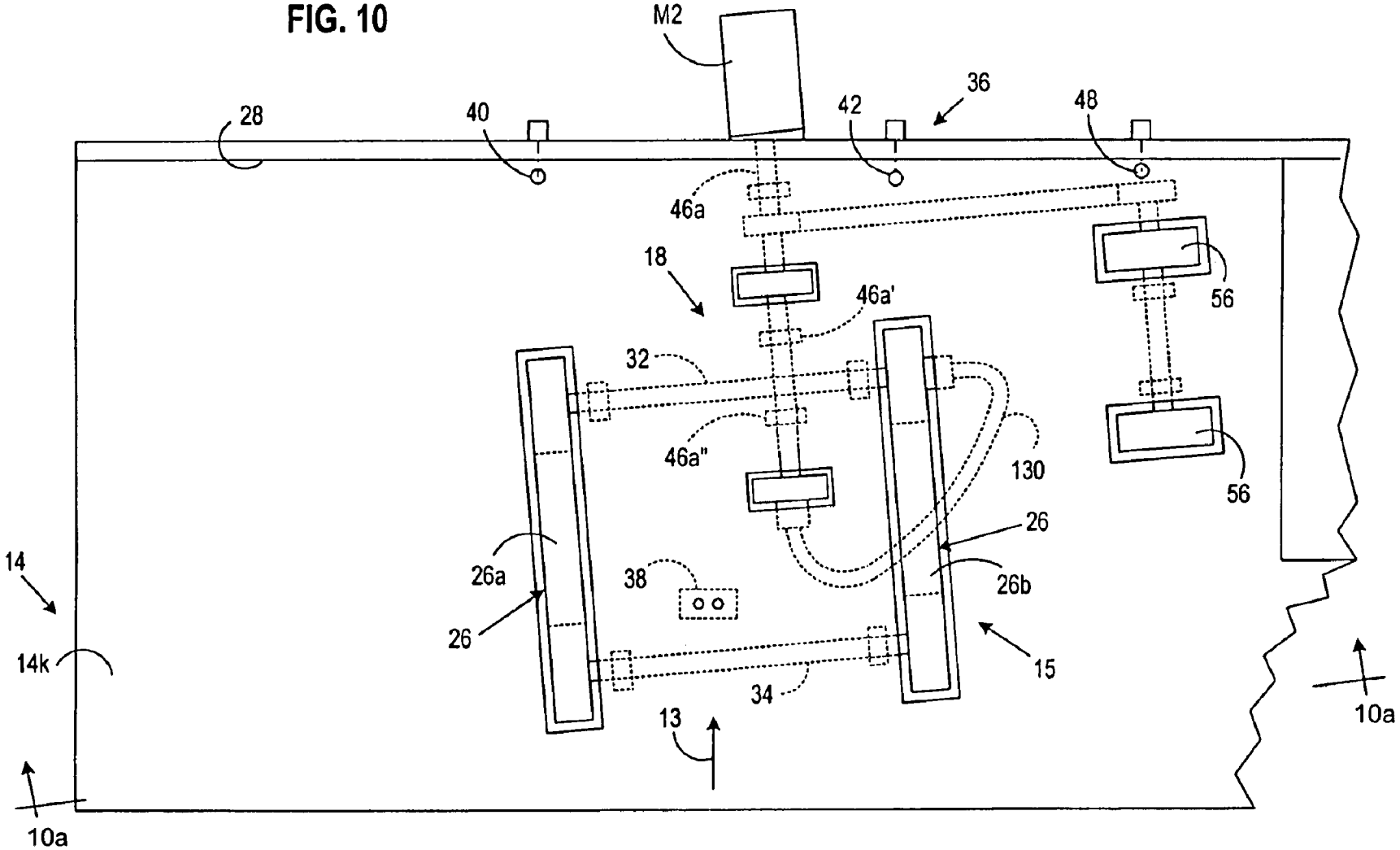
FIG. 10 is a plan view of an alternate embodiment VI of the present invention that utilizes a single drive motor, and a flexible drive shaft along with structure similar to that shown in embodiment II (FIGS. 6 and 6*a*).
Figure 10A:
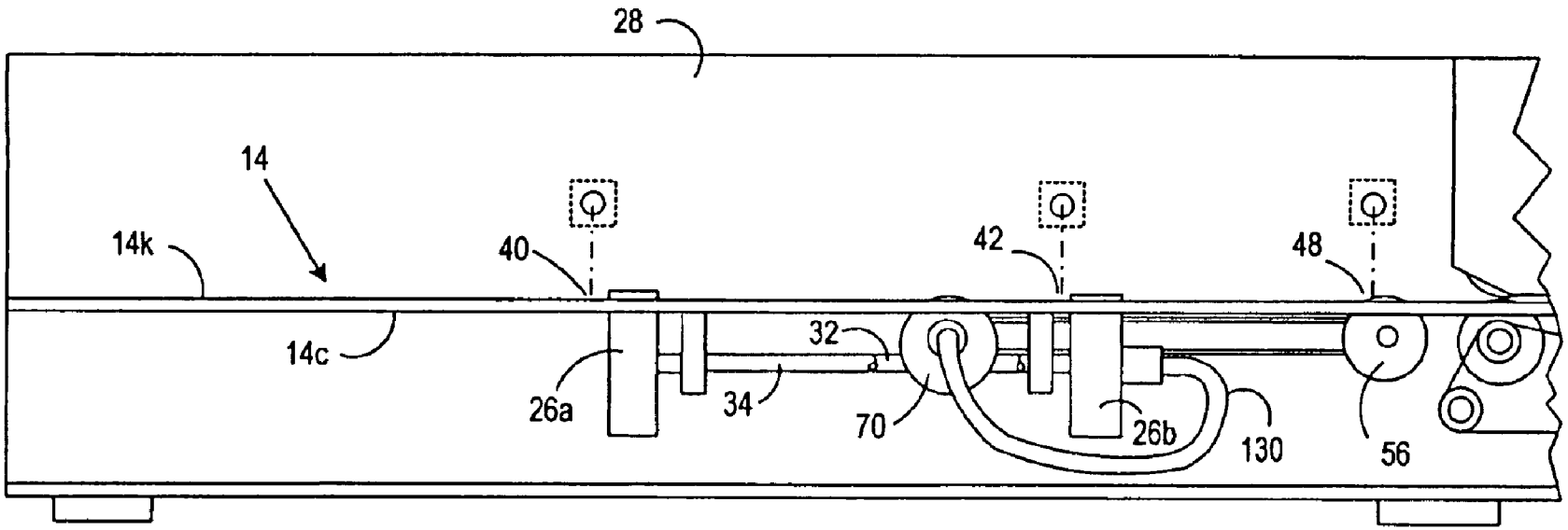
FIG. 10*a* is an elevation view taken along the lines of FIG. 10.

Referring to FIG. 10, and FIG. 10*a*, there is shown a plan view and a front elevation view of an alternate embodiment VI of the present invention. The basic structure previously defined in reference to the mailing machine 10 remains the same as that disclosed in reference to FIGS. 1, and 6 and those associated embodiments, with the following exceptions.

In FIG. 10, there is a flexible shaft 130 connected at one end to the shaft 46*a*, which is driven by the motor M2. The addition of the flexible shaft is another way to provide a right angled drive system for the pair of conveying belts 26 (26*a* & 26*b*). The operation is the same as that described for the embodiment I in FIG. 6.

Alternate Embodiment VII

Figure 11:
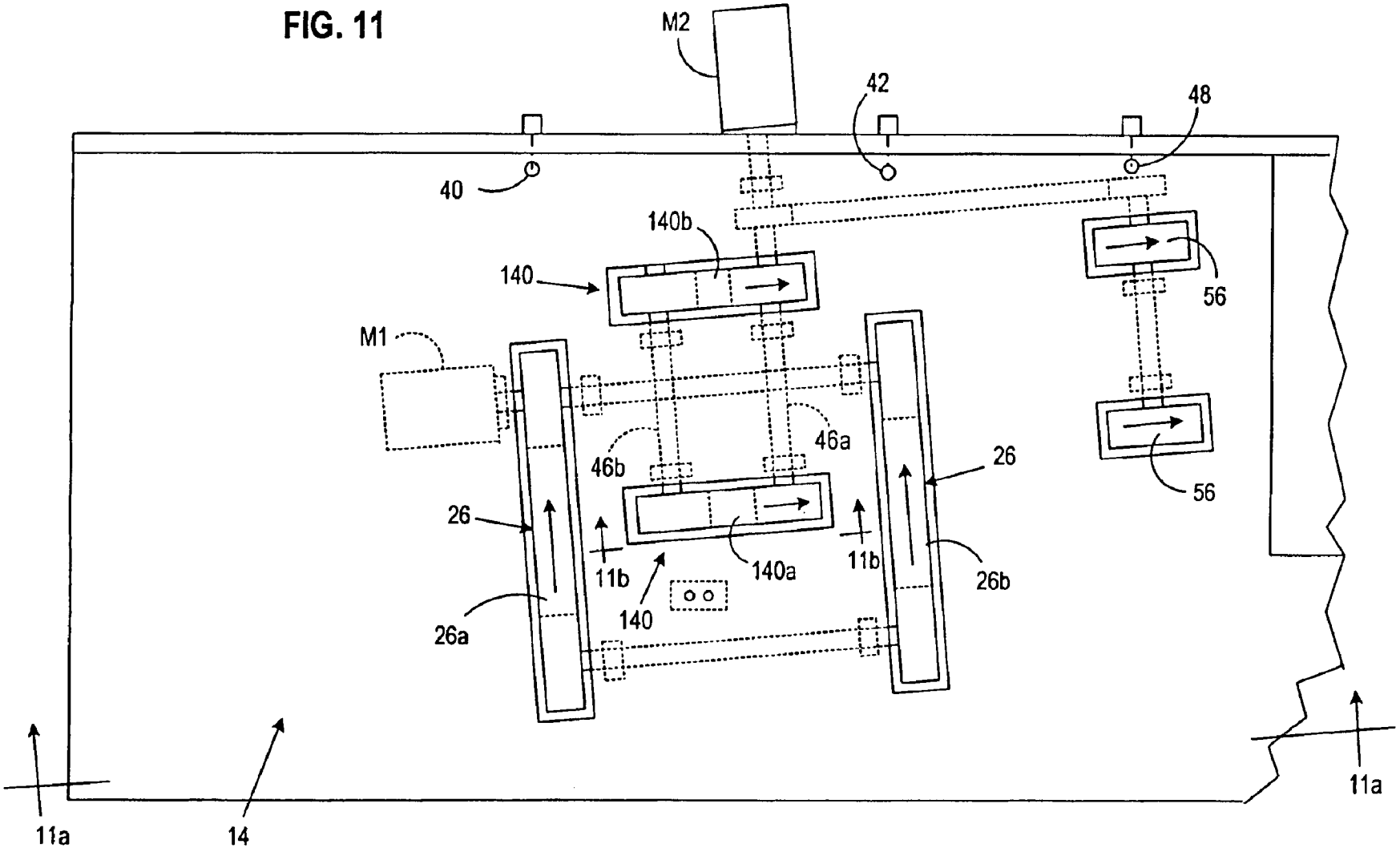
FIG. 11 is a plan view of an alternate embodiment VII of the present invention that utilizes a raised belt surface as a configuration for the second feeding apparatus.
Figure 11A:
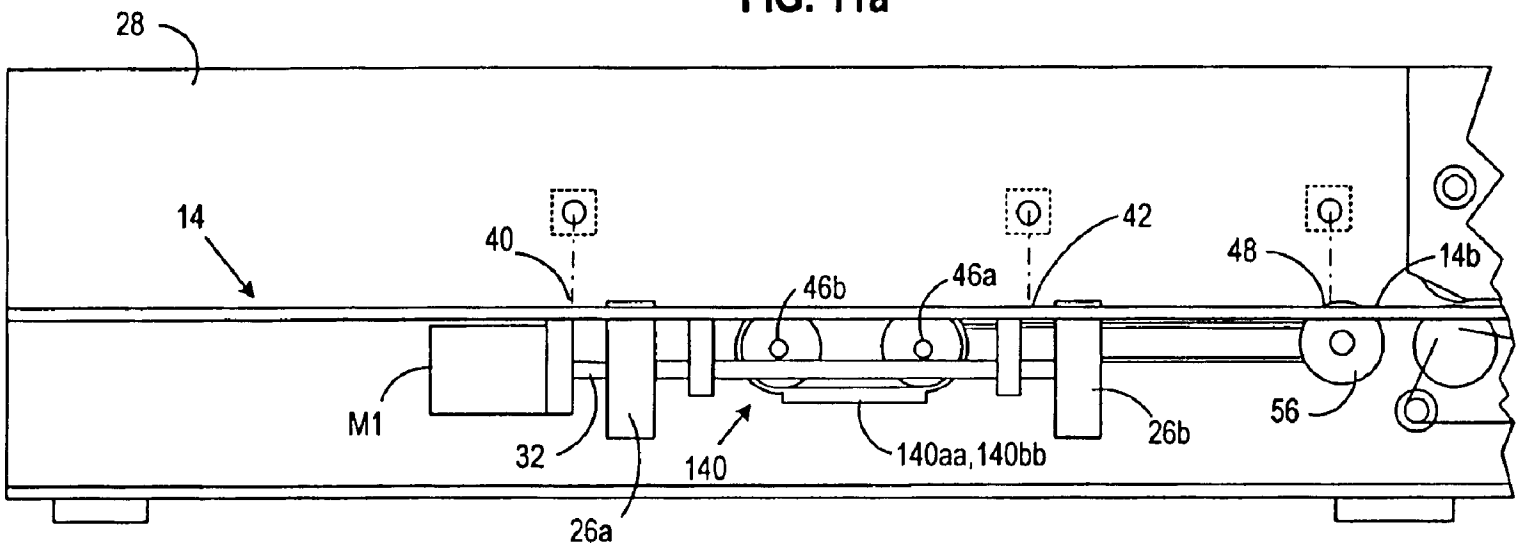
FIG. 11*a* is a front elevation view taken along the lines of FIG. 11.
Figure 11B:
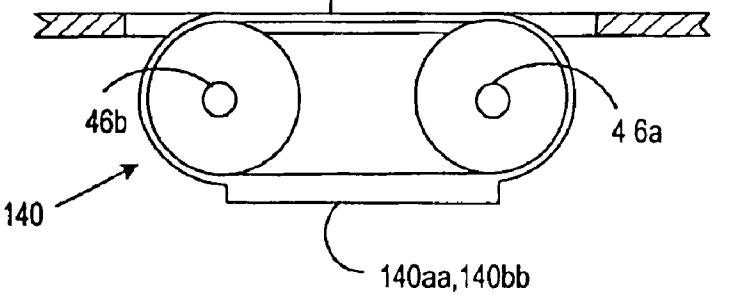
FIG. 11*b* is a slightly enlarged view taken along the lines of FIG. 11*a* showing a detail of the raised surface belt of the alternate embodiment VII.

Referring to FIG. 11, there is a arrangement of the first feeding apparatus 15 and second feeding apparatus 18, with the same general layout and design and embodiment associated and described for FIGS. 1, 2, and 3 with one exception. There is a set of conveying belts 140, including a front belt 140*a*, and a rear belt 140*b*. The belt 140*a* and 140*b* both has a raised portion 140*aa*, and 140*bb* respectively. The belts 140 are synchronous, so that when driven by motor M1, the raised portions 140*aa*, and 140*bb* on each belt move upward through the deck 14 to engage the envelopes, mail, or other articles. The raised portions 140*aa* and 140*bb* normally are in the position shown, where the pair of conveying belts 26 push the material over the surface of the belts 140*a* and 140*b*. The non raised portions of the belts 140*a* and 140*b* remain in a position parallel to or below the top side 14*k* of the feeding deck 14. The operation is the same as discussed for the embodiment shown and described for FIG. 1, where the sensors 40 and 42 activate motor M2 when an article is registered present and at the registration wall 28.

There may be other combinations of drive elements that can be applied to the system as described in all of the embodiments described in this specification, and it would be space consuming in the present specification to provide such other combinations that will be known and used by those skilled in the art. Therefore, the preceding detailed specification, drawings, and description of same sets forth examples of how the feeding and advancing system will function in sheet, envelope, mail, flat package, or other flat media processing equipment.

Further advantages and modifications will readily occur to those skilled in the art. Therefore, in its broader aspects, the invention is not limited to the specific details, and representative devices shown and described herein. Accordingly, various modifications may be made without departing from the spirit or scope of the general inventive concept as defined by the appended claims.

What is claimed is:

1. A feeding apparatus in a document processing machine for registering and advancing flat articles, comprising:

an input feeding deck;

a first feeding apparatus on the input feeding deck to feed an article along a first direction;

a second feeding apparatus provided on the input feeding deck to feed the article along a second direction oriented substantially orthogonal to the first direction;

a drive apparatus associated with the first and second feeding apparatus to continuously drive the article in the first direction against a registration wall while simultaneously feeding the article in the second direction.

* * * * *